US011293693B2

(12) United States Patent
Shao et al.

(10) Patent No.: US 11,293,693 B2
(45) Date of Patent: Apr. 5, 2022

(54) MODULAR OVEN STRUCTURE AND TUNNEL OVEN

(71) Applicant: JUSHI GROUP CO., LTD., Tongxiang (CN)

(72) Inventors: Jiansong Shao, Tongxiang (CN); Haijian Peng, Tongxiang (CN)

(73) Assignee: JUSHI GROUP CO., LTD., Tongxiang (CN)

( * ) Notice: Subject to any disclaimer, the term of this patent is extended or adjusted under 35 U.S.C. 154(b) by 45 days.

(21) Appl. No.: 16/770,397

(22) PCT Filed: Nov. 29, 2018

(86) PCT No.: PCT/CN2018/118181
§ 371 (c)(1),
(2) Date: Jun. 5, 2020

(87) PCT Pub. No.: WO2019/120056
PCT Pub. Date: Jun. 27, 2019

(65) Prior Publication Data

US 2020/0386477 A1 Dec. 10, 2020

(30) Foreign Application Priority Data

Dec. 22, 2017 (CN) ..... 201711399593.3

(51) Int. Cl.
*F26B 25/06* (2006.01)
*F26B 21/00* (2006.01)
(Continued)

(52) U.S. Cl.
CPC ..... *F26B 21/001* (2013.01); *F26B 21/02* (2013.01); *F26B 21/10* (2013.01); *F26B 25/066* (2013.01); *F26B 25/08* (2013.01)

(58) Field of Classification Search
CPC ..... F26B 21/001; F26B 21/02; F26B 21/10; F26B 21/00; F26B 25/066; F26B 25/00;
(Continued)

(56) References Cited

U.S. PATENT DOCUMENTS 3,850,224 A 11/1974 Vidmar et al.
2002/0148137 A1 10/2002 Eisenacher et al.
(Continued)

FOREIGN PATENT DOCUMENTS

CN 201163144 Y 12/2008
CN 202149677 U 2/2012
(Continued)

OTHER PUBLICATIONS

World Intellectual Property Organization (WIPO) International Search Report for PCT/CN2018/118181 dated Feb. 19, 2019 6 Pages.
(Continued)

*Primary Examiner* — John P McCormack
(74) *Attorney, Agent, or Firm* — Anova Law Group, PLLC

(57) ABSTRACT

A modular oven structure includes a frame, a circulation fan at a top of the frame, a tunnel air inlet chamber, a tunnel air return chamber, a tunnel drying chamber between the tunnel air inlet and tunnel air return chambers, a tunnel air inlet plate including air apertures and between the tunnel air inlet and tunnel drying chambers, a tunnel air return plate including air apertures and between the tunnel air return and tunnel drying chambers, a fan air inlet chamber above the tunnel drying chamber, a fan air outlet chamber between the fan air inlet chamber and the top of the frame, a heater, a temperature control system, and a control device. The temperature control system includes one or more temperature sensors in the tunnel air inlet, tunnel air return, and/or tunnel drying chamber.

8 Claims, 4 Drawing Sheets

(51) Int. Cl.
*F26B 21/02* (2006.01)
*F26B 21/10* (2006.01)
*F26B 25/08* (2006.01)

(58) Field of Classification Search
CPC .. F26B 25/08; F26B 25/12; F26B 3/04; F26B 15/16; F26B 13/00; F26B 13/001
USPC ..... 34/218, 224, 227
See application file for complete search history.

(56) References Cited

U.S. PATENT DOCUMENTS

| | | | | |
|---|---|---|---|---|
| 2007/0012340 | A1* | 1/2007 | Jones | B08B 3/022 134/45 |
| 2012/0168424 | A1 | 7/2012 | Cai et al. | |
| 2019/0316842 | A1* | 10/2019 | Moll | F26B 21/10 |

FOREIGN PATENT DOCUMENTS

| | | | | |
|---|---|---|---|---|
| CN | 204646248 | U | 9/2015 | |
| CN | 206531380 | U | 9/2017 | |
| CN | 207716799 | U | 8/2018 | |
| DE | 2418358 | A1 | 11/1975 | |
| DE | 19941184 | A1 | 3/2001 | |
| GB | 724057 | A | 2/1955 | |
| JP | 2005047100 | A | 2/2005 | |
| JP | 2006101752 | A | 4/2006 | |
| JP | 2007212090 | * | 8/2007 | F26B 21/04 |
| JP | 2007212090 | A | 8/2007 | |
| WO | 2011047555 | A1 | 4/2011 | |

OTHER PUBLICATIONS

Japan Patent Office Notice of Reasons for Refusal for Application No. 2020-528452 dated Jun. 1, 2021 12 pages (including translation).

European Patent Office Supplementary Partial European Search Report for Application No. EP18890594.7 dated Aug. 12, 2021 18 pages.

European Patent Office Supplementary European Search Report for Application No. EP18890594.7 dated Jan. 5, 2022 15 pages.

* cited by examiner

MODULAR OVEN STRUCTURE AND TUNNEL OVEN

CROSS-REFERENCE TO RELATED APPLICATIONS

The present application is a national stage entry under 35 U.S.C. § 371 of International Application No. PCT/CN2018/118181, filed on Nov. 29, 2018, which claims priority to Chinese Patent Application No. 201711399593.3 filed to State Intellectual Property Office on Dec. 22, 2017 and entitled "MODULAR OVEN STRUCTURE," the disclosures of both of which are incorporated herein by reference in their entireties.

TECHNICAL FIELD

The present disclosure relates to the field of oven technology, and in particular to an oven structure for drying glass fibers.

As a traditional building material, glass fiber has been widely used in recent years as a new material in wind power, high-speed rail, automobile and other fields. The scale of the glass fiber industry keeps expanding. At the same time, as a traditional industry, glass fiber production needs high energy consumption. Specifically, an oven serves as a key equipment that needs high energy input and has a great impact on product quality of glass fiber.

The oven in glass fiber production is usually very large and installed on floor. It needs a high circulation air flow rate and a large volume of air, and a circulation fan also needs to be large. The circulation fan is often arranged outside a drying chamber and in communication with the drying chamber via an air pipe. So the oven of this kind is large in size and its heat dissipation is high. Moreover, it is difficult to have a uniform air flow in a large drying chamber, which would thus affect the drying efficiency. A large oven is also not good-looking.

With the increase of production, larger ovens are often needed, which could reduce energy consumption per unit product to some extent. The industry needs a new type of oven which has good performance, reliable operation, and availability to increase production. This need can be met by a modular oven structure.

SUMMARY OF THE PRESENT DISCLOSURE

The present disclosure aims to solve the issue described above. The purpose of the present disclosure is to provide a modular oven structure to solve any of the above problems, and to provide a tunnel oven comprising a plurality of such modular oven structures. The oven can reduce production energy consumption, improve drying quality, increase the output according to demand and, with relatively simple configuration, enables easy implementation, stable operation and easy maintenance.

The present disclosure provides a modular oven structure comprising a frame and an air channel structure. A tunnel air inlet chamber, a tunnel air return chamber, and a tunnel drying chamber between the tunnel air inlet chamber and the tunnel air return chamber, are arranged in the frame. The tunnel drying chamber is used for drying materials. A tunnel air inlet plate is arranged between the tunnel air inlet chamber and the tunnel drying chamber, and a tunnel air return plate is arranged between the tunnel air return chamber and the tunnel drying chamber. A plurality of apertures are arranged both in the tunnel air inlet plate and in the tunnel air return plate.

A fan air inlet chamber is arranged above the tunnel drying chamber, and a heater is arranged in the fan air inlet chamber;

A fan air outlet chamber is arranged between the fan air inlet chamber and the top of the frame;

A circulation fan is arranged at the top of the frame, and an air inlet of the circulation fan is in communication with the top of the fan air inlet chamber;

The modular oven structure further comprises a temperature control system and a control device, wherein the temperature control system comprises several temperature sensors, and the temperature sensors are arranged in the tunnel air inlet chamber and/or the tunnel air return chamber, and/or in the tunnel drying chamber;

The output ends of the temperature sensors are connected to the control device, and an output end of the control device is connected to a control signal input end of the heater and a control signal input end of the circulation fan.

Wherein, the upper end of the tunnel air inlet chamber is in communication with the fan air outlet chamber, and the upper end of the tunnel air return chamber is in communication with the fan air inlet chamber.

Wherein, a circulation air filter is arranged between the tunnel air return chamber and the fan air inlet chamber.

Wherein, the heater can use various heating mode: electrical heating, steam heating, gas combustion heating, and hot air heating, and so forth.

Wherein, the circulation fan is an unhoused fan and is embedded into the oven structure from the top of the frame, so that it can be drawn out from the top of the oven structure to enable an easy maintenance.

The modular oven structure according to the present disclosure uses the frame and the air channel structure as a passage for air flow, so the air resistance is lowered, which is beneficial for energy conservation and consumption reduction.

Wherein, the inner wall of the frame is provided with a thermal insulation layer.

Wherein, the distribution density of apertures in the upper portion of the tunnel air inlet plate is higher than the distribution density of apertures in the lower portion of the tunnel air inlet plate, and the distribution density of apertures in the upper portion of the tunnel air return plate is lower than the distribution density of apertures in the lower portion of the tunnel air return plate.

The distribution densities of the apertures in the tunnel air inlet plate and in the tunnel air return plate are both different along the height direction of the tunnel air inlet plate and the tunnel air return plate. The distribution density of apertures in the upper portion of the tunnel air inlet plate is higher than the distribution density of apertures in the lower portion of the tunnel air inlet plate, and the distribution density of apertures in the upper portion of the tunnel air return plate is lower than the distribution density of apertures in the lower portion of the tunnel air return plate. In this way, the volumes of the hot air passing through the tunnel air inlet plate are basically the same at different height positions of the tunnel air inlet plate, and the volumes of the air passing through the tunnel air return plate are basically the same at different height positions of the tunnel air return plate. As a result, the flow rates of the horizontal air passing the tunnel drying chamber to dry materials therein are basically the same at different height positions of the tunnel drying chamber, which is conducive to achieving a stable drying quality.

The modular oven structure according to the present disclosure is provided with an oven door at each of the two ends of the oven structure, which facilitates the handling of materials. A separate modular oven structure can be used independently, and a plurality of modular oven structures can be combined and connected together to form a longer tunnel oven. Therefore, the present disclosure also provides a tunnel oven, which comprises a plurality of above-described modular oven structures connected in turn and interconnected with each other.

Wherein, the circulation air flows in opposite directions in the tunnel drying chambers of any two adjacent modular oven structures. Such opposite air flow can homogenize the drying effect for the materials on both sides of a tunnel drying chamber, which is conducive to achieving a stable drying quality.

Wherein, the two ends of the tunnel oven are each provided with an oven door which can move up and down, so that the total length of the tunnel oven can be reduced, and the materials to be dried can easily enter and exit the oven.

With respect to the control of drying temperature, one or more temperature sensors are arranged respectively in the tunnel air inlet chamber and the tunnel air return chamber of each modular oven structure to detect the temperature in the modular oven structure in real time. For the purpose of temperature control, the average of two or more temperature values detected in the tunnel air inlet chamber and the tunnel return air chamber is taken as the present value of temperature and compared with a set target value, which is conducive to achieving a stable drying quality.

The present disclosure does not specify the manners of materials entering and exiting the oven, as such manners largely depend on the shape and size of the materials to be dried. In combination with a specific way of materials entering and exiting the oven, the tunnel oven comprising the modular oven structures described above can enable intermittent drying of materials in batches. In this drying method, a batch of materials to be dried are firstly fed into the tunnel drying chamber; when the drying is completed, the materials are altogether released, and then a new batch of materials to be dried are fed into the tunnel drying chamber. The tunnel oven can also enable a continuous, cyclical drying of materials. In this drying method, the exit door of the oven is opened once after a given period of time, and part of the materials are released from the tunnel drying chamber, while the rest of the materials are moving towards the exit door of the oven; in the meantime or a moment later, the entrance door of the oven is opened, some materials are fed into the tunnel drying chamber to keep the chamber fully occupied, and then the entrance door and the exit door of the oven are closed to continue with the drying; and after the above-described given period of time this process will be repeated for drying the materials.

The beneficial effects of the oven structure according to the present disclosure include: evenly distributed hot air, good drying effect, good air circulation with low resistance, compact and simple structure, small surface area, energy saving, and easy maintenance; also, the tunnel oven comprising a plurality of modular oven structures in series connection enables large production capacity, continuous production and good looks.

BRIEF DESCRIPTION OF THE DRAWINGS

The drawings incorporated in the description and constituting a part of the description show some embodiments of the present disclosure, and are used for explaining the principle of the present disclosure in combination with the description. In these drawings, similar reference numerals represent similar elements. The drawings described hereinafter are some but not all of the embodiments of the present disclosure. A person of ordinary skill in the art can obtain other drawings according to these drawings without any creative effort.

DETAILED DESCRIPTION OF THE EMBODIMENTS

To make the objectives, technical solutions and advantages of the embodiments of the present disclosure clearer, the technical solutions in the embodiments of the present disclosure will be described clearly and completely with reference to the accompanying drawings in the embodiments of the present disclosure. Apparently, the described embodiments are just some but not all of the embodiments of the present disclosure. All other embodiments obtained by a person of ordinary skill in the art based on the embodiments of the present disclosure without paying any creative effort shall fall into the protection scope of the present disclosure. It is to be noted that the embodiments in the present disclosure and the features in the embodiments can be combined at will if not conflicted.

Figure 1:
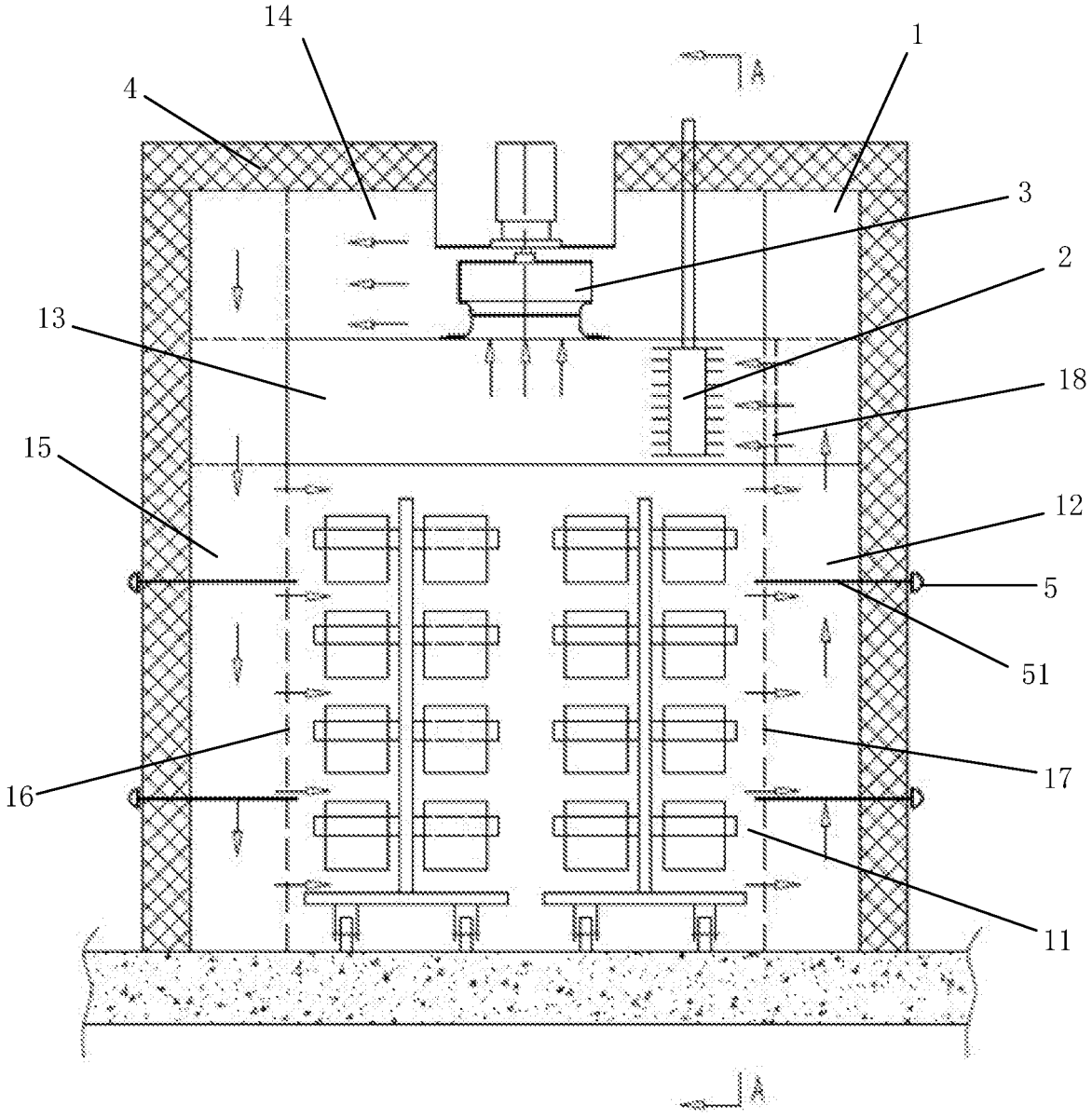
FIG. 1 is a schematic cross-sectional view of the modular oven structure according to the present disclosure.

FIG. 1 shows a modular oven structure comprising a frame, an air channel structure 1, a heater 2, a circulation fan 3, a thermal insulation layer 4, a temperature control system 5 and a control device (not shown). The frame and the air channel structure include a tunnel drying chamber 11, a tunnel air inlet chamber 15, a tunnel air inlet plate 16, a tunnel air return plate 17, a tunnel air return chamber 12, a circulation air filter 18, a fan air inlet chamber 13 and a fan air outlet chamber 14. The thermal insulation layer 4 is arranged on the inner wall of the frame to insulate the air channel structure. Wherein, the tunnel drying chamber 11 is arranged between the tunnel air inlet chamber 15 and the tunnel air return chamber 12; the tunnel air inlet plate 16 is arranged between the tunnel drying chamber 11 and the tunnel air inlet chamber 15, and the tunnel air return plate 17 is arranged between the tunnel drying chamber 11 and the tunnel air return chamber 12; a plurality of apertures are arranged both in the tunnel air inlet plate 16 and in the tunnel air return plate 17 for the purpose of facilitating hot drying air flow; the fan air inlet chamber 13 is arranged above the tunnel drying chamber 11, and the fan air outlet chamber 14 is arranged between the fan air inlet chamber 13 and the top of the frame 1.

The heater 2 is arranged in the fan air inlet chamber 13 for further heating the air (wind force) entering the air channel structure, so as to maintain the temperature of the wind force circulating in the channel and thus ensure the drying effect.

The circulation fan 3 is arranged at the top of the frame, and the air inlet of the circulation fan 3 is in communication with the top of the fan air inlet chamber 13, so the circulation fan 3 can take in the air from the fan air inlet chamber 13 and directly transmit the air to the fan air outlet chamber 14, and then to the tunnel air inlet chamber 15 for reuse.

The temperature control system 5 comprises several temperature sensors 51, and the several temperature sensors 51 are arranged in the tunnel air inlet chamber 15 and the tunnel air return chamber 12, to detect the temperature in the air channel structure 1 in real time and send the detection results to the control device. An output end of the control device is connected to a control signal input end of the heater 2 and a control signal input end of the circulation fan 3, so as to control the operation of the heater 2 and the circulation fan 3 based on the detection results of the temperature sensors 51 and the target temperature values set in the control device. When a detection result given by the temperature sensor 51 is higher than the set target temperature value, the control device controls the heater 2 to stop operation and starts the circulation fan 3 for air exchange; when a detection result of the temperature sensor 51 is lower than the set target temperature value, the control device controls the heater 2 to start and perform heating.

The upper end of the tunnel air inlet chamber 15 is in communication with the fan air outlet chamber 14, and the upper end of the tunnel air return chamber 12 is in communication with the fan air inlet chamber 13. The circulation air filter 18 is arranged between the tunnel air return chamber 12 and the fan air inlet chamber 13, to filter the air entering the fan air inlet chamber 13 from the tunnel air return chamber 12.

Specifically, the heater 2 can use various heating mode, such as electrical heating, steam heating, gas combustion heating, hot air heating, and so forth.

The circulation fan 3 is an unhoused fan and is embedded into the oven structure from the top of the frame, so that it can be drawn out from the top of the oven structure to enable an easy maintenance. The modular oven structure according to the present disclosure uses the frame and the air channel structure as a passage for air flow, so the air resistance is lowered, which is beneficial for reduction of energy consumption.

Figure 2:
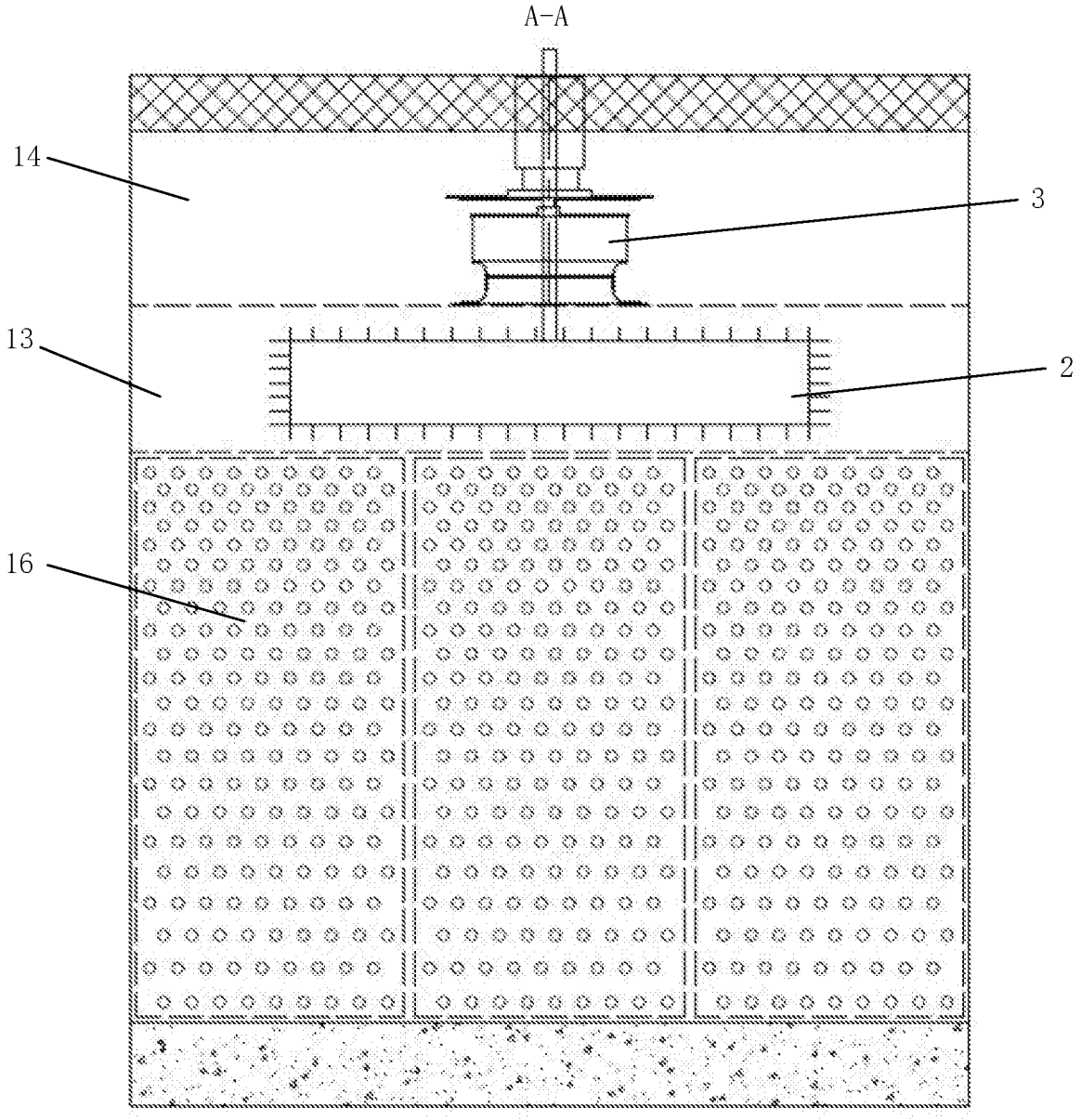
FIG. 2 is an A-A direction view of FIG. 1, showing a vertical section of the modular oven structure.
Figure 3:
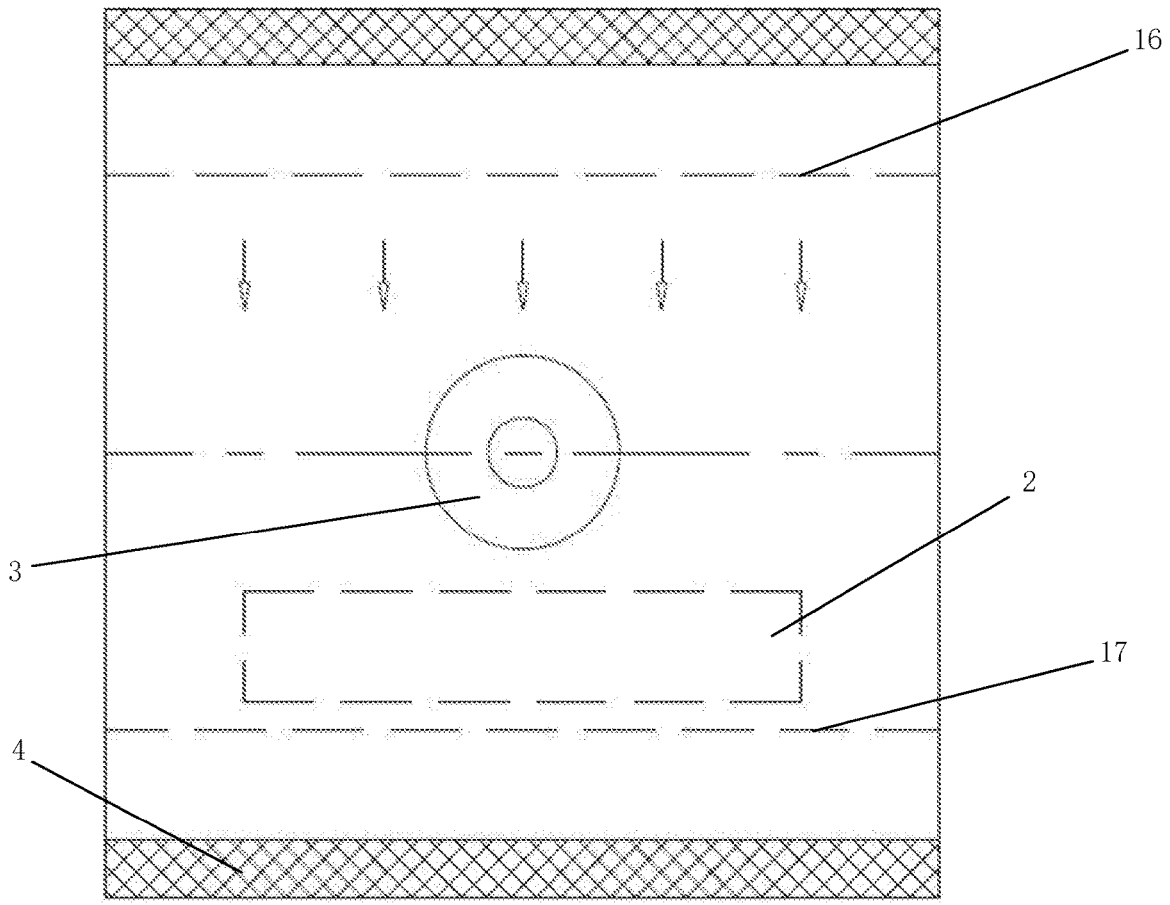
FIG. 3 is a top view of FIG. 1, showing the top of the modular oven structure.

As shown in FIG. 2, the distribution densities of the apertures in the tunnel air inlet plate 16 are different along the height direction of the tunnel air inlet plate 16 in that the distribution density of apertures in the upper portion of the tunnel air inlet plate 16 is higher than the distribution density of apertures in the lower portion of the tunnel air inlet plate 16. Similarly, the distribution densities of the apertures in the tunnel air return plate 17 are also different along the height direction of the tunnel air return plate 17 in that the distribution density of apertures in the upper portion of the tunnel air return plate 17 is lower than the distribution density of apertures in the lower portion of the tunnel air return plate 17. In this way, the volumes of the hot air passing through the tunnel air inlet plate 16 are basically the same at different height positions of the tunnel air inlet plate 16, and the volumes of the air passing through the tunnel air return plate 17 are basically the same at different height positions of the tunnel air return plate 17. As a result, the flow rates of the horizontal air passing the tunnel drying chamber 11 to dry materials therein are basically the same at different height positions of the tunnel drying chamber 11, which is conducive to achieving a stable drying quality.

The modular oven structure with the tunnel drying chamber 11 being provided with two doors at each end of the chamber is a complete oven and can be used independently. Or otherwise a plurality of modular oven structures can be combined to form a longer tunnel oven. When combined, the flow direction of the circulation air in the tunnel drying chamber 11 of one modular oven structure is opposite to the flow directions of the circulation air in the tunnel drying chambers 11 of adjacent modular oven structures.

Figure 4:
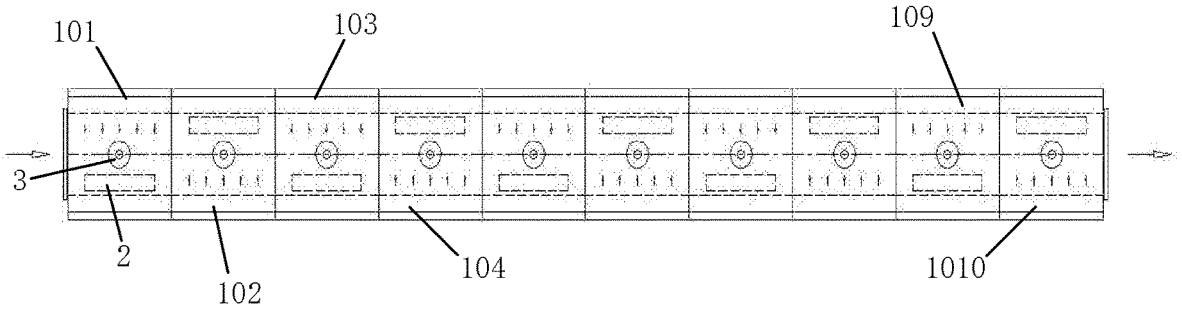
FIG. 4 is a top view of a long tunnel oven formed by a plurality of modular oven structures.

As shown in FIG. 4, another modular oven structure, i.e., a second modular oven structure 102, is rotated horizontally by 180 degrees and then connected to the first modular oven structure 101; then another modular oven structure, i.e., a third modular oven structure 103, is connected to the second modular oven structure 102 without being rotated; then another modular oven structure, i.e., a fourth modular oven structure 104, is rotated by 180 degrees and then connected to the third modular oven structure 103; and so on so forth, until a tenth modular oven structure 1010 is connected to a ninth modular oven structure 109. In this way, the circulation air in the tunnel drying chamber 11 of the second modular oven structure 102 flows in an opposite direction to that in the tunnel drying chamber 11 of the first modular oven structure 101. Among the modular oven structures shown in FIG. 10, the circulation airs in any two adjacent modular oven structures flow in opposite directions, and the circulation airs in any two modular oven structures that are separated by another modular oven structure flow in the same direction. The left-right alternating directions of the circulation airs can help to ensure a uniform drying effect for the materials on both sides of a tunnel drying chamber, which is conducive to achieving a stable drying quality.

Referring to FIG. 1, the temperature control system 5 comprises one or more temperature sensors 51 arranged in each of the tunnel air inlet chamber 15 and the tunnel air return chamber 12 of each modular oven structure. For the purpose of temperature control, the average of two or more temperature values detected in the tunnel air inlet chamber 15 and the tunnel air return chamber 12 is taken as the present value of the temperature and compared with a set target value to perform temperature control, which is conducive to achieving a stable drying quality. Normally, the air volume and the air flow rate are high in the oven, and the difference between the air temperature in the oven and the air temperature in the tunnel air return chamber 12 after cooled by the materials is not large. That is, the difference between the air temperature in the tunnel air inlet chamber 15 or in the tunnel air return chamber 12 and the air temperature in the central area of the tunnel drying chamber 11 when contacting the materials to be dried, is not large. Controlling the temperature according to the average value will not cause problems of high temperature difference between two sides. This drying method with high air flow rate and low temperature gradient is beneficial to improve the drying quality.

Figure 5:
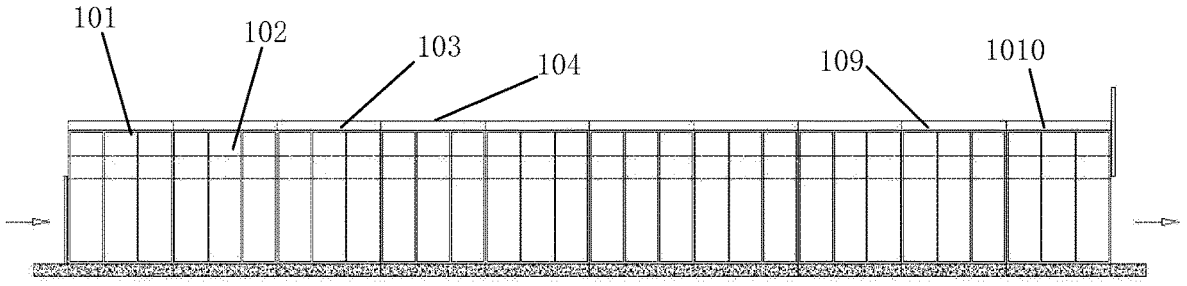
FIG. 5 is a front view of FIG. 4, showing an elevation of the long tunnel oven formed by the plurality of modular oven structures.

As shown in FIG. 5, the two ends of the tunnel oven comprising a plurality of above-described modular oven structures are each provided with an oven door which can move up and down, so that the total length of the tunnel oven can be reduced, and the materials to be dried can easily enter and exit the oven.

The present disclosure does not specify the manners for the materials to be dried to enter and exit the oven, as the entering and exiting manners are closely related to the shape and size of the materials. In combination with a specific way of materials entering and exiting the oven, the tunnel oven comprising the modular oven structures described above can enable intermittent drying of materials in batches. In this drying method, a batch of materials to be dried are firstly fed into the tunnel drying chamber; when the drying is completed, the materials are altogether released, and then a new batch of materials to be dried are fed into the tunnel drying chamber. The tunnel oven can also enable a continuous, cyclical drying of materials. In this drying method, the exit door of the oven is opened once after a given period of time, and part of the materials are released from the tunnel drying chamber, while the rest of the materials are moving towards the exit door of the oven; in the meantime or a moment later, the entrance door of the oven is opened, some materials are fed into the tunnel drying chamber to keep the chamber fully occupied, and then the entrance door and the exit door of the oven are closed to continue with the drying. And after the above-described given period of time this process will be repeated for drying the materials.

According to the present disclosure, the hot air from the circulation fan 3 at the top of the oven structure passes successively through the fan air outlet chamber 14, the tunnel inlet chamber 15 and the tunnel air inlet plate 16, and then enters the tunnel drying chamber 11 from one side and, after drying the materials therein, flows out of the other side of the tunnel drying chamber 11. The hot air then passes successively through the tunnel air return plate 17 and the tunnel air return chamber 12 and, after being heated by the heater 2, enters the fan air inlet chamber 13, and then is sucked in by the circulation fan 3 for drying in the next cycle. In this way, the hot air is reused.

The contents described above can be implemented independently or in combination in various manners, and these transformations shall fall into the protection scope of the present disclosure.

The specific dimension values of the components listed herein are exemplary numerical values, and the dimension parameters of different components can have different numerical values as needed in practical operations.

It is to be noted that, as used herein, the term "comprise/comprising," "contain/containing" or any other variants thereof is non-exclusive, so that an object or a device containing a series of elements contains not only these elements, but also other elements not listed clearly, or further contains inherent elements of the object or device. Unless otherwise defined herein, an element defined by the statement "comprises/comprising an/a . . . " does not exclude other identical elements in the object or device including this element.

The foregoing embodiments are merely used for describing the technical solutions of the present disclosure and not intended to constitute any limitations thereto, and the present disclosure has been described in detail merely by referring to certain embodiments. It should be understood by a person of ordinary skill in the art that modifications or equivalent replacements can be made to the technical features of the present disclosure without departing from the spirit and scope of the technical solutions of the present disclosure, and these modifications or equivalent replacements shall fall in the scope defined by the appended claims of the present disclosure.

INDUSTRIAL APPLICABILITY

The oven structure according to the present disclosure has the beneficial effects of evenly distributed hot air, good drying effect, good air circulation with low resistance, compact and simple structure, small surface area, energy saving, and easy maintenance; also, the tunnel oven comprising a plurality of modular oven structures in series connection enables large production capacity, continuous production and good looks.

What is claimed is:

1. A modular oven structure comprising:

a frame;

a circulation fan arranged at a top of the frame;

a tunnel air inlet chamber;

a tunnel air return chamber;

a tunnel drying chamber arranged between the tunnel air inlet chamber and the tunnel air return chamber;

a tunnel air inlet plate arranged between the tunnel air inlet chamber and the tunnel drying chamber, the tunnel air inlet plate including a plurality of first apertures;

a tunnel air return plate arranged between the tunnel air return chamber and the tunnel drying chamber, the tunnel air return plate including a plurality of second apertures;

a fan air inlet chamber above the tunnel drying chamber and in communication with an air inlet of the circulation fan;

a fan air outlet chamber arranged between the fan air inlet chamber and the top of the frame;

a heater arranged in the fan air inlet chamber;

a temperature control system including one or more temperature sensors, the one or more temperature sensors including at least one of a first temperature sensor arranged in the tunnel air inlet chamber, a second temperature sensor arranged in the tunnel air return chamber, or a third temperature sensor arranged in the tunnel drying chamber; and a control device connected to an output end of each of the one or more temperature sensors, an output end of the control device being connected to a control signal input end of the heater and a control signal input end of the circulation fan;

wherein:

a distribution density of the first apertures in an upper portion of the tunnel air inlet plate is higher than a distribution density of the first apertures in a lower portion of the tunnel air inlet plate; and a distribution density of second apertures in an upper portion of the tunnel air return plate is lower than a distribution density of second apertures in a lower portion of the tunnel air return plate.

2. The modular oven structure according to claim 1, further comprising:

a circulation air filter arranged between the tunnel air return chamber and the fan air inlet chamber.

3. The modular oven structure according to claim 1, wherein the heater is configured to heat using at least one of electrical heating, steam heating, gas combustion heating, or hot air heating.

4. The modular oven structure according to claim 1, wherein the circulation fan includes an unhoused fan and is configured to be mounted into the modular oven structure from the top of the frame.

5. The modular oven structure according to claim 1, further comprising:

a thermal insulation layer provided at an inner wall of the frame.

6. A tunnel oven comprising a plurality of modular oven structures of claim 1 connected in turn and interconnected with each other.

7. The tunnel oven according to claim 6, wherein circulation airs flow in opposite directions in the tunnel drying chambers of two adjacent modular oven structures.

8. The tunnel oven according to claim 6, further comprising:

two oven doors at two ends of the tunnel oven, respectively, each of the two oven doors being capable of moving up and down.

* * * * *